US005582344A

United States Patent [19]

Lawson et al.

[11] Patent Number: 5,582,344

[45] Date of Patent: Dec. 10, 1996

[54] RESEALABLE CONTAINER FOR PULVERIZED MATERIALS INCORPORATING FRAGRANCE-PRODUCING INGREDIENTS

[75] Inventors: Frederick W. Lawson, Somerset; Grace A. Behrend, Englishtown; Frank E. Lindsay, Hamilton Township, all of N.J.

[73] Assignee: Church & Dwight Co., Inc., Princeton, N.J.

[21] Appl. No.: 561,548

[22] Filed: Nov. 21, 1995

Related U.S. Application Data

[63] Continuation of Ser. No. 184,864, Jan. 24, 1994, abandoned.

[51] Int. Cl.[6] ..... B65D 5/70

[52] U.S. Cl. ..... 229/217; 220/462; 229/3.1; 229/132

[58] Field of Search ..... 229/3.1, 3.5 R, 229/215, 217, 219, 229, 234, 132; 206/0.5, 802; 220/418, 462; 428/34.2, 36.6; 222/541

[56] References Cited

U.S. PATENT DOCUMENTS

| | | | |
|---|---|---|---|
| 2,555,526 | 6/1951 | Zinn, Jr. | 229/234 |
| 2,750,096 | 6/1956 | Misch | 229/234 |
| 2,975,074 | 3/1961 | Jankens et al. | 229/3.5 R |
| 3,018,197 | 1/1962 | Covington et al. | 229/3.5 R |
| 3,599,859 | 8/1971 | Maierson | 229/222 |
| 3,622,439 | 11/1971 | Manne et al. | 229/3.5 R |
| 3,625,348 | 12/1971 | Titchenal et al. | 229/3.5 R |
| 3,625,409 | 12/1971 | Ito et al. | 229/3.5 R |
| 3,713,849 | 1/1973 | Grindrod et al. | 229/3.5 R |
| 4,015,768 | 4/1977 | McLennan | 229/234 |
| 4,220,281 | 9/1980 | Masters, III et al. | 206/0.5 |
| 4,308,956 | 1/1982 | Steinke et al. | 229/234 |
| 4,508,226 | 4/1985 | Davis et al. | 229/132 |
| 4,795,665 | 1/1989 | Lancaster et al. | 428/34.2 |
| 5,330,845 | 7/1994 | Andersson et al. | 428/34.2 |

FOREIGN PATENT DOCUMENTS

| | | | |
|---|---|---|---|
| 615973 | 3/1961 | Canada | 229/217 |

OTHER PUBLICATIONS

The Wiley Encyclopedia of Packaging Technology, John Wiley and Sons, pp. 692–696, (1986).

*Primary Examiner*—Gary E. Elkins
*Attorney, Agent, or Firm*—Irvino Fishman

[57] ABSTRACT

A resealable fiber board container for pulverized fragrance-producing ingredients, e.g., for carpet deodorizer formulations, the interior walls of which incorporate a polyvinylidene chloride coating for limiting the escape of fragrance from the container. The coating may be readily stripped from the container after use to facilitate environmentally sound disposal.

3 Claims, 2 Drawing Sheets

FIG. 1
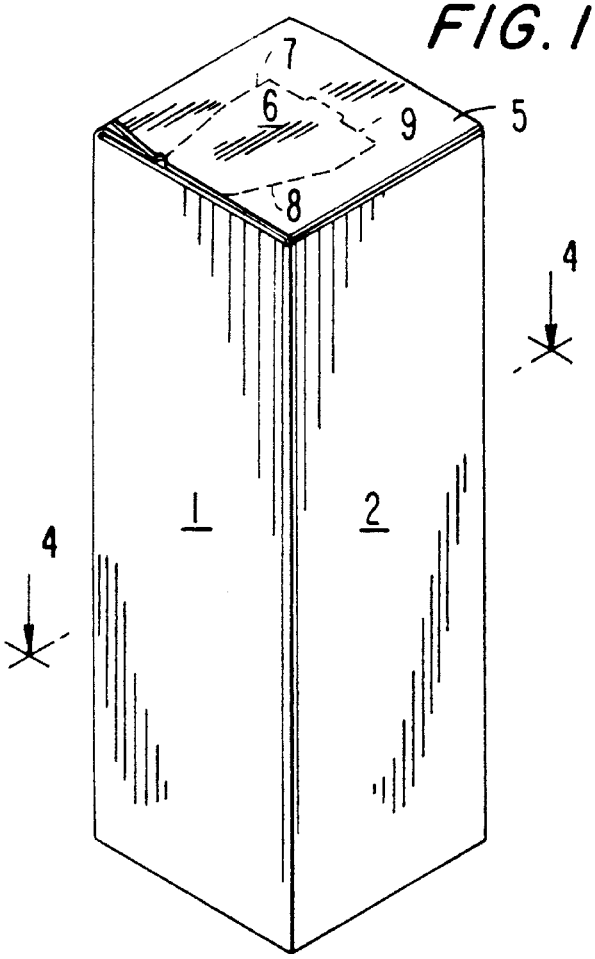
FIG. 2
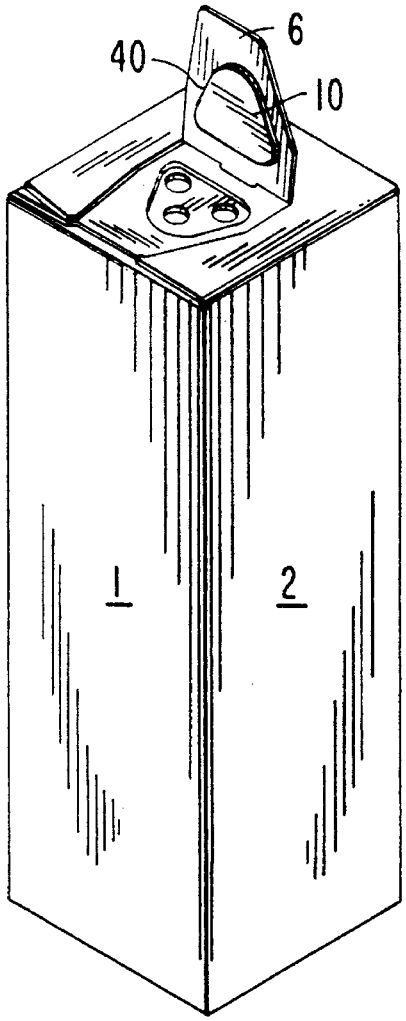
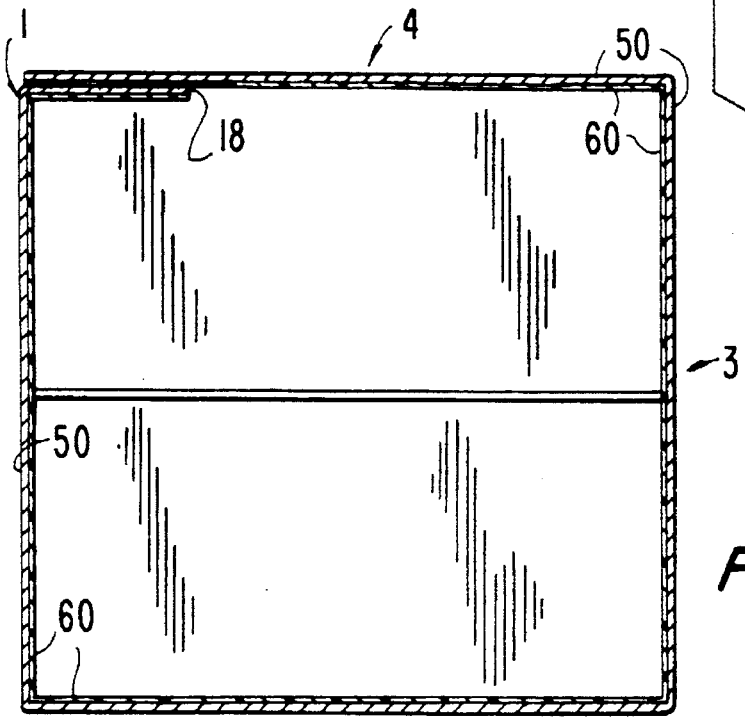
FIG. 4

RESEALABLE CONTAINER FOR PULVERIZED MATERIALS INCORPORATING FRAGRANCE-PRODUCING INGREDIENTS

This is a continuation of U.S. application Ser. No. 08/184,864, filed Jan. 24, 1994, now abandoned.

This invention relates to a resealable fiber board container for solid, pulverized materials incorporating fragrance-producing ingredients useful as consumer products, which products may be economically stored, shipped, marketed and used by the consumer without appreciable loss of the fragrance therefrom.

BACKGROUND OF THE INVENTION

Box-like fiber board containers or cartons for powders or other pulverized materials have long been utilized for consumer products. One such container is described in Steinke et al U.S. Pat. No. 4,308,956 granted Jan. 5, 1982 and owned by the assignee of the present invention. The container described therein has been used for several years for dispensing powdered carpet deodorizers comprising sodium bicarbonate in admixture with various fragrance-producing ingredients. It has been found, however, that the fragrances produced by such products tend to escape through the walls of the container during shipment and/or storage with the consequent risk that the powdery carpet deodorizer may be unscented or only poorly scented when used by the consumer.

In order to overcome this problem in the commercial marketing of carpet deodorizer products, the resealable containers of the type described in the Steinke et al patent were originally heat-sealed in a polyvinyl chloride ("PVC") overwrap during storage and shipment. The PVC overwrap provided good fragrance retention until its at least partial removal by the consumer. However, when the wrapping was removed, it was found that the fragrances quickly dissipated through the walls of the fiber board containers. The overwrapping technique thus imposed additional manufacturing and marketing operations and expense, and were of limited effect in preserving the fragrances prior to use of the products by the ultimate consumer.

Subsequently, barrier coatings have been developed for the fiber board walls of containers of the type described in the Steinke et al patent which are intended to prevent the fragrance from escaping through the container walls and simultaneously prevent moisture from passing through the porous fiber board walls and agglomerating the powdery contents thereof. Initially, polyethylene terephthalate ("PET") barrier coatings have been utilized for such purpose. Such coatings may be readily adhesively bonded to fiber board with a minimum of additional processing steps, and, unlike the previously utilized PVC overwrap, are not subsequently removed. Employing existing destripping equipment, however, the adhesively bonded PET coatings cannot be readily separated from the fiber board without the risk of "gumming-up" the equipment. Accordingly, while the PET-coated barrier board provides satisfactory fragrance retention properties prior to consumer use, its use nevertheless poses substantial environmental problems.

It is among the objects of the present invention to provide an improved resealable container of the type described in the aforesaid Steinke et al patent for dispensing pulverized materials incorporating fragrance-producing ingredients, which container limits escape of the fragrance prior to use, and yet which container may be economically produced and effectively processed after disposal by the consumer for materials reclamation.

SUMMARY OF THE INVENTION

In accordance with the present invention, an improved resealable fiber board container for pulverized materials incorporating fragrance-producing ingredients is provided. The container has a top portion, a bottom portion and four side portions, the top portion being formed by a hinged flap of each side portion. The outer-most of the flaps is adapted to open the container to permit dispensing the pulverized materials and reclosing of the container to prevent loss of the materials and to limit the escape of fragrance from the container after its initial opening. In accordance with the present invention, a polyvinylidene chloride ("PVDC") barrier coating is coated on or adhesively bonded to the interior walls of the container to limit if not totally prevent the escape of fragrance through the porous fiber board. In this manner, the loss of fragrance is minimized, both during the shipment and storage of the product prior to and at the point of consumer sale, and after purchase and partial use by the consumer.

The PVDC barrier coating may be applied during manufacture of the resealable container at minimum additional expense. Moreover, after consumer use the PVDC coating may be readily stripped from the fiber board substrate without risk of gumming-up conventional stripping equipment, and the materials may be reclaimed without the necessity for disposal in a landfill or the like.

Other objects and advantages of the invention will be apparent from the following detailed description, taken in connection with the accompanying drawings in which:

BRIEF DESCRIPTION OF THE DRAWINGS

FIG. 1 is a perspective view of a preferred embodiment of the invention, illustrating the resealable container in its closed configuration;

FIG. 2 is a perspective view similar to FIG. 1, showing the preferred embodiment with the container open to permit dispensing of a pulverized material contained therein;

FIG. 4 is a cross-section viewed in the direction of line 4—4 in FIG. 1, showing the PVDC barrier coating on the interior walls of the container.

DETAILED DESCRIPTION

Figure 3:
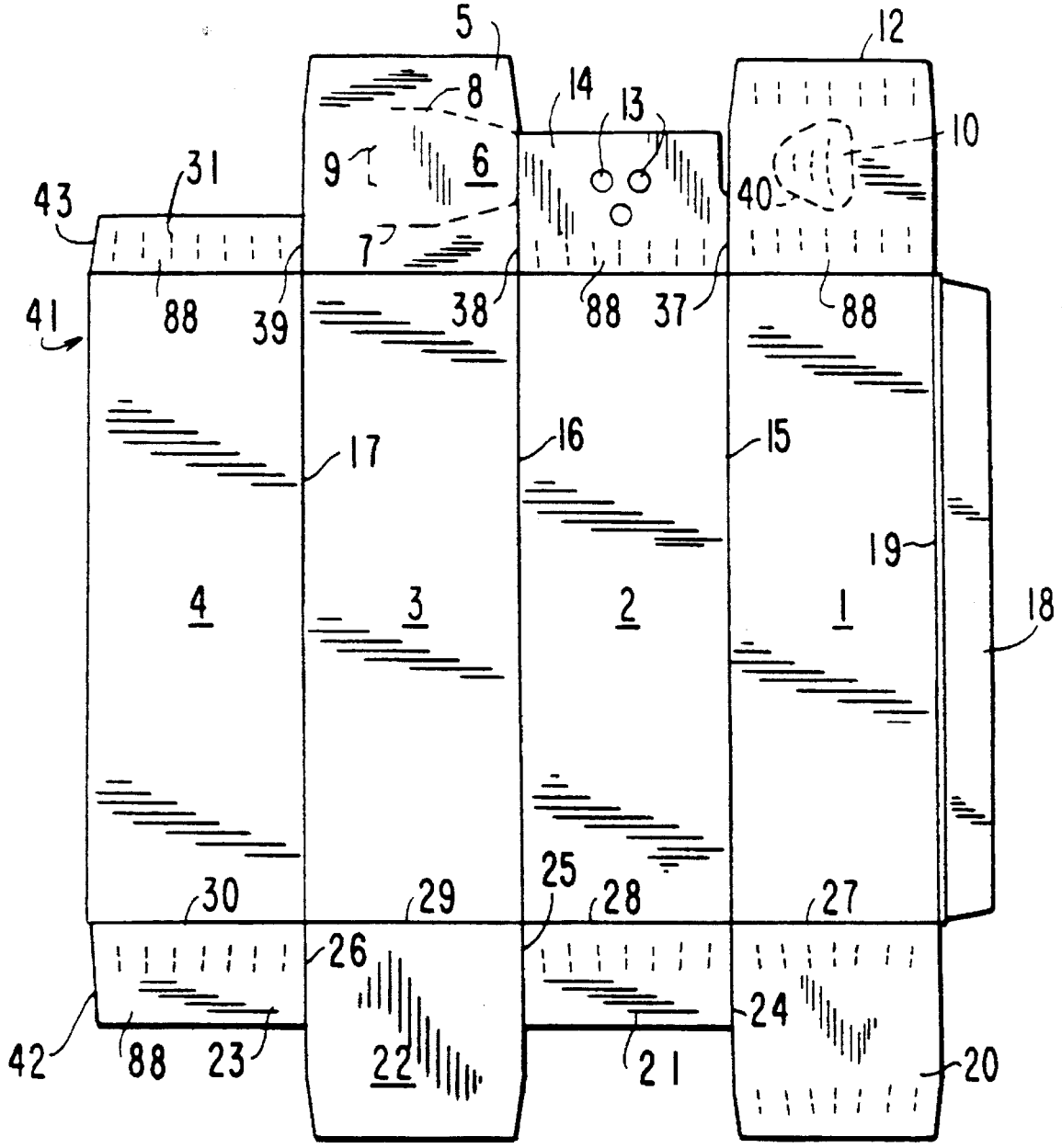
FIG. 3 shows a barrier board blank as cut and creased preparatory to folding to form the preferred embodiment illustrated (the blank being viewed from the side forming the interior of the container)

The preferred embodiment of the resealable container of the invention is illustrated in the drawings, employing the same reference numerals used in the drawings of the aforesaid Steinke et al Patent to designate like parts. The container comprises side-wall portions 1, 2, 3 and 4, a top portion or flap 5 and a bottom portion, formed as described hereinafter. The container walls, including the top, bottom and side portions thereof, are formed of a conventional fiber board, e.g., a porous cardboard (which may have been recycled), pasteboard, kraft, solid bleached sulfate ("SBS") or like material, as known in the art.

In accordance with the invention, the interior surfaces of the fiber board walls 50 (see FIG. 4) have a PVDC barrier coating 60 formed thereon. The fiber board walls may generally range from about 0.015 to 0.030 inch, preferably about 0.025 inch, in thickness, with the PVDC coating having a thickness ranging from about 0.004 to about 0.006 inch, preferably about 0.0045 to 0.0055 inch. Employing such thicknesses, the fiber board may readily be formed into the resealable container of the invention with the PVDC coating forming a substantially complete vapor/moisture seal to limit the escape of fragrance volatilized from the fragrance-producing ingredients within the container, as well as the ingress of moisture from outside the container. (It is intended that, as used herein, reference to limiting the escape of the fragrance volatilized embraces both substantially limiting and totally preventing the escape of such fragrance from the container of the invention.)

The PVDC coating may comprise any conventional vinylidene chloride polymer which is sufficiently vapor/liquid impermeable as to limit the escape of conventional fragrances and the penetration of ambient moisture vapor through the walls of the container of the invention. As used herein, the term "PVDC coating" embraces both conventional coatings and discrete laminae of single or multi-layer films, e.g., laminates of PVDC with cellophane, polypropylene ("PP") or the like. The PVDC coating may be applied by spraying, dipping or casting techniques, with or without pre-coating with suitable adhesive materials. It should be understood that the PVDC coating may be applied by any conventional, known technique for the formation of thin, conventional PVDC coatings or films.

The configuration of the resealable container whose interior walls incorporate the PVDC barrier coating of the invention is best shown in FIGS. 1 and 2. As illustrated therein, the top portion 5 comprises an outermost hinged flap portion 6 which is formed by die-cut, perforated lines 7 and 8 and is hinged at score line 9. The top portion 5 of the container is further defined by an inner-most flap 31 hinged to sidewall 4, a second inner-most flap 14 hinged to sidewall 2 and a second outer-most flap 12 hinged to sidewall 1.

The inner-most flap 31 extends over only a part of top portion 5 of the container. Flap 14, the second inner-most flap, overlaps flap 31 and incorporates a number of dispensing openings 13 through which pulverized material may be dispensed after filling the container. As shown, the dispensing openings can be circular holes which are wide enough to permit dispensing of the powder or pulverized material therethrough. Typically, as shown the dispensing openings 13 comprise 3 evenly spaced circular holes, each of which has a diameter of from about 0.05 to 0.125 inch.

The second outer-most flap 12 incorporates a die-cut piece 10 formed by a die-cut, perforated outline 40. The outline may be relatively smooth as illustrated in the present drawings or, alternatively, jagged or serrated (as illustrated in FIG. 2 of the aforesaid Steinke et al patent). In the assembled container the die-cut piece 10 is aligned with the dispensing openings 13 in flap 14 and glued to the hinged flap portion 6 of the outer-most flap. Providing perforated line 40 in a relatively continuous configuration minimizes the risk of interference with opening of the top portion of the container and removal of the die-cut piece 10 from the second inner-most flap 12 by webbing of the PVDC layer.

FIG. 2 illustrates the container of the invention after it has been opened by tearing hinge flap 6 along the perforated lines 7 and 8 and pivoting the flap into a raised position. When the hinged flap is thus opened, the die-cut piece 10 glued thereto is cut from the second outer-most flap, leaving an opening 11 in the second outer-most flap 12 which opening is aligned with the dispensing openings 13 in flap 14. The container contents may thus be dispensed through openings 13 and 11. In this manner, the PVDC barrier coating limits the escape of any volatilized fragrance both prior to opening the hinged flap portion 6 and after the flap portion has been closed to re-seal the container after use.

FIG. 3 illustrates the PVDC-coated barrier board 41 from which the resealable container is assembled. Side walls 1, 2, 3 and 4 of the container are formed by score lines 15, 16, and 17. Glue leg be is formed by score line 19. Bottom flaps 20, 21, 22 and 23 are separated by die-cut lines 24, 25 and 26 and are formed by score lines 27, 28, 29 and 30.

Top flaps 5, 12, 14 and 31 are separated from one another by die-cut lines 37, 38 and 39. Bottom flap 23 and top flap 31 are both slightly tapered along lines 42 and 43 so as to eliminate or alleviate binding of the flaps during folding, facilitating assembly of the container on a high-speed assembly line.

To form the container, glue leg 18 is glued to the interior surface of side wall 4 so that lines 19 and 41 (the edges of side walls 4 and 1) touch each other. The bottom of the container is formed by folding in bottom flaps 21 and 23 to lie in the same plane. Bottom flap 20 is then folded in, followed by bottom flap 22. Glue-assist perforations 88 (indicated in dotted line in FIG. 3) aid in maintaining a tight bond between all surfaces of the container which are glued together.

Top flaps 5, 12, 14 and 31 are folded in the following order. Top flap 31 is folded first (the innermost flap); top flap 14 is folded second (the second innermost flap); top flap 12 is folded third (the second-outermost flap); and top flap 5 is folded fourth (the outermost flap). Top flap 12 is glued to top flaps 14 and 13; top flap 5 is glued to top flap 12.

Die-cut piece 10 is independently glued to hinged flap 6 so that raising the hinged flap 6 removes the die-cut piece 10 from opening 11. Dispensing openings 13 in top flap 14 are therefore exposed, permitting the powder or particulate matter to be dispensed as indicated above. Lowering hinged flap 6 and pressing it down replaces die-cut piece 10 in opening 11, resealing the container.

EXAMPLES

The fragrance barrier properties of the PVDC barrier board container of the present invention were compared with the like properties of the prior commercial embodiments of the resealable container of the Steinke et al patent, and with containers incorporating a variety of other barrier boards, by both user panels and chemical analyses. The specific procedures employed in the respective tests are described below.

Example 1

Panel Testing of Containers Incorporating Various Barrier Board Materials, and PVC-Overwrapped Containers User panel tests were carried out to compare fragrance retention of containers incorporating a number of different barrier materials and containers overwrapped with PVC, over a three month period. In the tests carpet deodorizer compositions incorporating pulverized sodium bicarbonate and various fragrance-producing ingredients were divided into several portions. Portions of each deodorizer composition were refrigerated (at 40° F.) in glass containers, maximizing fragrance retention. The other portions were placed in the test containers described below, and stored at 100° F. for up to three months. Samples were taken from unopened containers at the end of one, two and three months and compared for fragrance retention with the corresponding refrigerated samples.

In the panel tests, each of twenty panelists with fragrance stability testing experience made blind comparisons of the refrigerated samples with the corresponding container-stored samples utilizing different barrier materials. The members of the panel were asked to give the most fragrant sample a score of 10 and to rate the less fragrant samples, in comparison, on a scale of 1 to 10 with 10 representing a fragrance equivalent to that exhibited by the most fragrant sample. The scores given by each panelist were then averaged and multiplied by ten to give the figures shown in Table 1–4 below. The % retention of the several test products incorporating each of four different fragrance-producing ingredients is tabulated in TABLE 1, and the overall (average) % retention of the respective products as to all of the fragrances tested is tabulated in TABLE 2. The % retention of the various fragrances visa vis corresponding containers overwrapped with PVC is tabulated in TABLE 3. Finally, the average % retention as to all of the fragrances tested visa vis the PVC-wrapped containers is tabulated in TABLE 4.

TABLE 1

Barrier Board Retention of Individual Fragrances

| BARRIER | EVALUATION 100° F. Samples vs. 40° Controls | FRAGRANCE % Fragrance Retention "Lt. Scent" [9] | "Country Fresh" [10] | "Pet Fresh" [11] | "CL Additive" [12] | Average |
|---|---|---|---|---|---|---|
| EXAMPLE 1 (PVDC/PP/PVDC Laminate)[1] | 1 month | 82.5 | 88.5 | 84.0 | 87.5 | 85.6 |
| | 2 months | 78.0 | 86.0 | 80.0 | 84.0 | 82.0 |
| | 3 months | 67.0 | 76.5 | 73.0 | 72.5 | 72.2 |
| | Average | 75.8 | 83.7 | 79.0 | 81.3 | 79.9 |
| CONTROL A (PVDC/PET Laminate)[2] | 1 month | 87.0 | 92.0 | 86.5 | 88.5 | 88.5 |
| | 2 months | 81.5 | 86.5 | 83.0 | 91.5 | 85.6 |
| | 3 months | 73.5 | 83.5 | 78.5 | 78.5 | 78.5 |
| | Average | 80.7 | 87.3 | 79.0 | 81.3 | 79.9 |
| CONTROL B (PET Laminate)[3] | 1 month | 87.5 | 91.5 | 83.0 | 87.5 | 87.4 |
| | 2 months | 86.0 | 85.0 | 81.0 | 85.5 | 84.4 |
| | 3 months | 82.0 | 82.5 | 80.0 | 84.5 | 82.3 |
| | Average | 85.2 | 86.3 | 81.3 | 85.8 | 84.7 |
| CONTROL C (Inside Film Laminate)[4] | 1 month | 79.5 | 87.0 | 77.5 | 87.5 | 82.9 |
| | 2 months | 78.0 | 79.5 | 71.0 | 82.5 | 77.8 |
| | 3 months | 67.0 | 71.5 | 63.5 | 73.5 | 68.8 |
| | Average | 74.8 | 79.3 | 70.7 | 81.0 | 76.4 |
| CONTROL D (PP Laminate)[5] | 1 month | 77.0 | 81.0 | 77.0 | 76.0 | 77.8 |
| | 2 months | 77.5 | 83.5 | 77.5 | 78.5 | 79.3 |
| | 3 months | 64.5 | 69.0 | 68.0 | 68.5 | 67.5 |
| | Average | 73.0 | 77.8 | 74.2 | 74.3 | 74.8 |
| CONTROL E (PP Laminate, Metallized)[6] | 1 month | 83.5 | 85.0 | 77.0 | 85.0 | 82.6 |
| | 2 months | 74.5 | 78.0 | 73.0 | 89.5 | 78.8 |
| | 3 months | 75.5 | 74.0 | 71.0 | 78.5 | 74.8 |
| | Average | 77.8 | 79.0 | 73.7 | 84.3 | 78.7 |
| CONTROL F (PP Laminate, Non-metallized[7] | 1 month | 80.5 | 90.0 | 79.0 | 83.5 | 83.3 |
| | 2 months | 67.5 | 80.5 | 76.0 | 84.5 | 77.1 |
| | 3 months | 65.0 | 74.0 | 67.5 | 80.0 | 71.6 |
| | Average | 71.0 | 81.5 | 74.2 | 82.7 | 77.3 |
| CONTROL G (PVC Overwrap)[8] | 1 month | 84.5 | 87.5 | 84.5 | 89.0 | 86.4 |
| | 2 months | 82.5 | 84.0 | 81.5 | 84.0 | 83.0 |
| | 3 months | 75.0 | 78.5 | 69.5 | 82.0 | 76.3 |
| | Average | 80.7 | 83.3 | 78.5 | 85.0 | 81.9 |

[1]Container constructed from a 24 pt. clay coated Newsback board laminated to a PVDC (SARAN ®) /PP/PVDC interior laminate.
[2]Container constructed from a 24 pt. clay coated Newsback board laminated to a PVDC (SARAN ®)/PET interior laminate.
[3]Container constructed from a 24 pt. clay coated Newsback board laminated to a PET interior laminate.
[4]Container constructed from a 24 pt. clay coated Newsback board laminated to an inside film laminate of PP sandwiched between the board and Kraft paper.
[5]Container constructed from a 24 pt. clay coated Newsback board laminated to a PP interior laminate.
[6]Container constructed from a 24 pt. double Kraft lined board with a metallized PP exterior barrier (COMPOSIPAC ®).
[7]Container constructed from a 24 pt. double Kraft lined board with a non-metallized PP exterior barrier (COMPOSIPAC ®).
[8]Container constructed from a 24 pt. SBS board with a PVC (TERMOVIR ®) outer wrapper.
[9]A mixture of fragrance-producing ingredients available from Dragoco Incorporated of Totowa, NJ as Dragoco 0/707348.
[10]A mixture of fragrance-producing ingredients available from Fragrance Resources Incorporated of Keyport, NJ as fragrance No. FR89F/1520M.
[11]A mixture of fragrance-producing ingredients available from Drom International Inc. of Towaco, NJ as fragrance No. 95525A.
[12]A mixture of fragrance-producing ingredients available from Frangrance Resources Incorporated of Keyport, NJ as fragrance No. 90F/2199.

TABLE 2

| | Average Barrier Board Retention of All Fragrances | | | | |
|---|---|---|---|---|---|
| | % FRAGRANCE RETENTION | | | 3 MONTH | COMPARISON WITH |
| CONTAINER | 1 MONTH | 2 MONTHS | 3 MONTHS | AVERAGE | CONTROL G |
| EXAMPLE 1 (PVDC/PP/PVDC Laminate) | 85.6 | 82 | 72.2 | 79.9 | −2.0 |
| CONTROL A (PVDC/PET Laminate) | 88.5 | 85.6 | 78.5 | 84.2 | +2.3 |
| CONTROL B (PET Laminate) | 87.4 | 84.4 | 82.3 | 84.7 | +2.8 |
| CONTROL C (Inside Film Laminate) | 82.9 | 77.8 | 67.5 | 76.1 | −5.8 |
| CONTROL D (PP Laminate) | 77.8 | 79.3 | 67.5 | 75.2 | −6.7 |
| CONTROL E (PP Laminate, Metallized) | 82.6 | 78.7 | 74.8 | 78.7 | −3.2 |
| CONTROL F (PP Laminate, Non-Metallized) | 83.3 | 77.1 | 71.6 | 77.3 | −4.6 |
| CONTROL G (PVC Overwrap) | 86.4 | 83 | 76.2 | 81.9 | — |

TABLE 3

| | Barrier Board vs PVC Overwrap Fragrance Retention | | | | | |
|---|---|---|---|---|---|---|
| | EVALUATION 100° F. Barrier | FRAGRANCE Level Comparisons | | | | |
| BARRIER[1/] | vs. 100° PVC Overwrap | Lt. Scent | Country Fresh | Pet Fresh | CL Additive | Average |
| EXAMPLE 1 | 1 month | 87.9 | 88.9 | 94.7 | 100.0 | 92.9 |
| (PVDC/PP/ | 2 months | 85.4 | 87.9 | 87.7 | 97.0 | 89.5 |
| PVDC | 3 months | 77.5 | 83.1 | 85.2 | 95.7 | 85.4 |
| Laminate) | Average | 83.6 | 86.6 | 89.2 | 97.6 | 89.3 |
| CONTROL A | 1 month | 100.6 | 102.3 | 101.3 | 104.8 | 102.3 |
| (PVDC/PET | 2 months | 101.8 | 101.8 | 100.5 | 100.0 | 101.0 |
| Laminate) | 3 months | 95.5 | 101.1 | 101.1 | 99.3 | 99.3 |
| | Average | 99.3 | 101.7 | 101.0 | 101.4 | 100.9 |
| CONTROL B | 1 month | 93.1 | 104.4 | 90.1 | 85.4 | 93.3 |
| (PET | 2 months | 96.4 | 101.1 | 97.9 | 96.6 | 98.0 |
| Laminate) | 3 months | 100.0 | 102.2 | 102.0 | 102.8 | 101.8 |
| | Average | 96.5 | 102.6 | 96.7 | 94.9 | 97.7 |
| CONTROL C | 1 month | 86.9 | 104.6 | 87.6 | 96.6 | 93.9 |
| (Inside | 2 months | 86.4 | 97.1 | 86.6 | 95.1 | 91.3 |
| Film | 3 months | 84.7 | 86.0 | 79.5 | 83.4 | 83.4 |
| Laminate) | Average | 86.0 | 95.9 | 84.6 | 91.7 | 89.6 |
| CONTROL D | 1 month | 94.5 | 99.4 | 81.5 | 98.3 | 93.4 |
| (PP | 2 months | 83.5 | 92.6 | 81.2 | 91.9 | 87.3 |
| Laminate) | 3 months | 76.9 | 83.1 | 81.3 | 83.9 | 81.3 |
| | Average | 85.0 | 91.7 | 81.3 | 91.4 | 87.4 |
| CONTROL E | 1 month | 97.2 | 95.7 | 88.9 | 96.2 | 94.5 |
| (PP | 2 months | 87.3 | 93.6 | 84.0 | 90.1 | 88.8 |
| Laminate, | 3 months | 84.6 | 93.7 | 84.8 | 87.9 | 87.8 |
| Metallized) | Average | 89.7 | 94.3 | 85.9 | 91.4 | 90.3 |
| CONTROL F | 1 month | 87.5 | 98.1 | 91.5 | 98.9 | 94.0 |
| (PP | 2 months | 74.0 | 87.0 | 93.3 | 88.5 | 85.7 |

TABLE 3-continued

| | Barrier Board vs PVC Overwrap Fragrance Retention | | | | | |
|---|---|---|---|---|---|---|
| | EVALUATION 100° F. Barrier | FRAGRANCE Level Comparisons | | | | |
| BARRIER[1/] | vs. 100° PVC Overwrap | Lt. Scent | Country Fresh | Pet Fresh | CL Additive | Average |
| Laminate, | 3 months | 70.8 | 92.9 | 83.2 | 92.5 | 84.8 |
| Non-metallized | Average | 77.4 | 92.7 | 89.3 | 93.3 | 88.2 |

[1/]Each of the test containers incorporated 0.55% of the respective fragrance-producing ingredients, save for the PVC-overwrapped containers which incorporated 0.6% of the PVC-overwrap.

TABLE 4

| | Average Fragrance Retention of Barrier Board vs. PVC Overwrap | | | |
|---|---|---|---|---|
| | COMPARISON VS. PVC OVERWRAP | | | 3 MONTH |
| PACKAGE[1/] | 1 MONTH | 2 MONTHS | 3 MONTHS | AVERAGE |
| EXAMPLE 1 (PVDC/PP/PVDC Laminate) | 92.9 | 89.5 | 85.4 | 89.4 |
| CONTROL A (PVDC/PET Laminate) | 102.2 | 101.0 | 99.2 | 100.8 |
| CONTROL B (PET Laminate) | 93.3 | 98.0 | 101.7 | 97.7 |
| CONTROL C (Inside Film Laminate) | 93.9 | 91.3 | 83.4 | 89.5 |
| CONTROL D (PP Laminate) | 93.4 | 87.3 | 81.3 | 87.3 |
| CONTROL E (PP Laminate, Metallized) | 94.5 | 88.7 | 87.7 | 90.3 |
| CONTROL F | 94.0 | 85.7 | 84.3 | 88.0 |
| CONTROL G (PVC Overwrap) | — | — | — | — |

[1/]Each of the test containers incorporated 0.55% of the respective fragrance-producing ingredients, save for the PVC-overwrapped containers which incorporated 0.6% of the PVC-overwrap.

It may be seen from TABLES 1–4 that the overall percent fragrance retention exhibited by the PVDC/PP/PVDC Laminate (EXAMPLE 1) was almost as high throughout the three month test period as achieved with the PVC Overwrap package (CONTROL G) or the alternative barrier products, CONTROLS C–F. The containers incorporating the PVDC Laminate (EXAMPLE 1), while less effective than CONTROLS A and B in fragrance retention, could be readily disposed of after use by stripping off the barrier layer, as compared with these PET laminates.

Examples 2–7

Accelerated Testing of PVDC and Other Barrier Board Materials

A number of additional barrier board materials, PET coated barrier boards (CONTROLS A and B) and PVC-overwrapped, untreated fiber board (CONTROL G) were subjected to an accelerated test procedure, as follows.

Initially, a two ounce glass jar was ¾ filled with the desired fragrance and placed uncovered inside a four ounce glass jar having a ¾" I.D. hole drilled in the center of its cap. A 2⅛" I.D. circle of each test barrier board was cut and placed in the lid of the four ounce jar (barrier portion facing inwards) and sealed into place around the perimeter of the inside of the cap with vinyl tape. After screwning the cap onto the jar, it was sealed along the outside of the cap with vinyl tape, the four ounce jar was then placed inside a 32 ounce glass jar having a ¾" I.D. hole drilled in the center of its cap, and the cap was sealed with vinyl tape. A stopper was placed in the hole in the cap on the 32 ounce jar.

After sitting at room temperature for 24 hours the jars were evaluated by a panel of 20 individuals. In an initial screening test, a negative control (an uncoated SBS board) was first evaluated and assigned a "10" value. The further test samples were then rated on a 0 (maximum residual fragrance) to 10 (same fragrance level as the negative control) basis. The results of the initial screen of eleven barrier boards, with the results reported as an average of the ratings, are set forth in Table 5:

TABLE 5

| BARRIER | % Fragrance Passed Through Barrier Boards in Screening Test — FRAGRANCE: "Pet Fresh" | "Country Fresh" | "Fresh Country Breeze"[8/] | Average |
|---|---|---|---|---|
| EXAMPLE 1 (PVDC/PP/PVDC Laminate) | 42 | 21 | 31 | 31 |
| EXAMPLE 2 (PVDC Laminate)[1/] | 7 | 20 | 31 | 19 |
| EXAMPLE 3 (PVDC Coating A)[2/] | 28 | 23 | 32 | 28 |
| EXAMPLE 4 (PVDC Coating B)[3/] | 34 | 18 | 20 | 24 |
| EXAMPLE 5 (Clay Coated PVDC Laminate)[4/] | 48 | 43 | 46 | 46 |
| EXAMPLE 6 (PVDC Coating C)[2/] | 44 | 35 | 66 | 48 |
| EXAMPLE 7 (PVDC Coating D)[2/] | 47 | 42 | 50 | 46 |
| CONTROL B (PET Laminate) | 30 | 20 | 23 | 24 |
| CONTROL G (PVC Overwrap) | 23 | 24 | 31 | 26 |
| CONTROL H (Acrylic Coating)[5/] | 79 | 56 | 49 | 61 |
| CONTROL I (SUN Coating)[6/] | 58 | 60 | 68 | 62 |
| CONTROL J (SLE Coating)[7/] | 80 | 57 | 69 | 69 |

[1/]Barrier board constituted of Newsback board bonded to a laminate of cellophane sandwiched between two layers of PVDC, available as K25 Laminate from Field Container Corporation of Elk Grove Village, Illinois.
[2/]Barrier board constituted of Newsback board coated with a PVDC coating, available as V-93 Coating from Field Container Corporation of Elk Grove Village, Illinois, applied by varying techniques designed to modify porosity of the coating.
[3/]Barrier board constituted of Newsback board coated with a PVDC coating and an acrylic sealant from the Container Corp. of America.
[4/]Barrier board constituted of Newsback board bonded to a PVDC laminate overcoated with clay, available from Roymal.
[5/]Barrier board constituted of Newsback board coated with the acrylic sealant incorporated in PVDC Coating B.
[6/]Barrier board constituted of Newsback board coated with a coating identified as SUN coating, available from the Container Corp. of America.
[7/]Barrier board constituted of Newsback board coated with a coating identified as SLE coating, available from the Container Corp. of America.
[8/]A mixture of fragrance-producing ingredients available from Creations Aromatiques as fragrance CA G92-150.

The four best barrier materials tested in the aforesaid screening operation (EXAMPLES 1–4), and CONTROLS B and G were then subjected to further accelerated testing by the foregoing procedure, employing six additional fragrance-producing ingredients. (The barriers of EXAMPLES 5–7 were prepared from the same PVDC materials as those of EXAMPLES 3 and 4, except that the latter formulations were less porous and hence more vapor impermeable, accounting for their superior vapor retention properties in the foregoing screen.)

The accelerated test data for EXAMPLES 1–4 and CONTROLS B and G are summarized in TABLE 6 below:

TABLE 6

| FRAGRANCE> | % Fragrance Passed Through PVDC Barrier Boards In Accelerated Testing: "Pet Fresh" | "Country Fresh" | "Fresh Country Breeze" | "Light Scent" | "Super Pet Fresh"[1/] | "Mountain Fresh"[2/] | "Spring Fresh"[3/] | "Citrus Fresh"[4/] | "Tropical Fresh"[5/] | Avg. All Fragrances |
|---|---|---|---|---|---|---|---|---|---|---|
| Barrier | | | | | | | | | | |
| EXAMPLE 1 (PVDC/PP/PVDC Laminate) | 42 | 21 | 31 | 30 | 31 | 39 | 35 | 18 | 22 | 31.5 |
| EXAMPLE 2 (PVDC Laminate) | 7 | 20 | 31 | 24 | 23 | 17 | 38 | 11 | 35 | 22.6 |
| EXAMPLE 3 (PVDC Coating A) | 28 | 23 | 32 | 29 | 41 | 23 | 38 | 14 | 30 | 28.3 |

TABLE 6-continued

| FRAGRANCE> | % Fragrance Passed Through PVDC Barrier Boards In Accelerated Testing | | | | | | | | | |
|---|---|---|---|---|---|---|---|---|---|---|
| | "Pet Fresh" | "Country Fresh" | "Fresh Country Breeze" | "Light Scent" | "Super Pet Fresh"[1/] | "Mountain Fresh"[2/] | "Spring Fresh"[3/] | "Citrus Fresh"[4/] | "Tropical Fresh"[5/] | Avg. All Fragrances |
| EXAMPLE 4 (PVDC Coating B) | 34 | 18 | 20 | 30 | 24 | 34 | 29 | 41 | 40 | 31.2 |
| CONTROL B (PET Laminate) | 30 | 20 | 23 | 20 | 19 | 25 | 33 | 19 | 20 | 23.4 |
| CONTROL G (PVC Overwrap) | 23 | 24 | 31 | 32 | 17 | 19 | 30 | 20 | 27 | 25.4 |

[1/]A mixture of fragrance-producing ingredients available from Fragrance Resources as FR-2147.
[2/]A mixture of fragrance-producing ingredients available from Drom as Drom 96661/5C.
[3/]A mixture of fragrance-producing ingredients available from Fragrance Resources as FR 90F/1720R.
[4/]A mixture of fragrance-producing ingredients available from Dragoco Incorporated as Dragoco 0/71-6485.
[5/]A mixture of fragrance-producing ingredients available from International Flavors and Fragrances of Union Beach, NJ as IFF 5478-HT.

The PVDC barrier board material of EXAMPLE 1, which exhibited excellent fragrance resistance in the foregoing room temperature accelerated test procedure was subjected to a high temperature (122° F.), two week accelerated test, employing the accelerated test protocol described above in connection with EXAMPLES 2–7. The results, as compared with CONTROLS B and G, are set forth in TABLE 7:

TABLE 7

| BARRIER FRAGRANCE> | % Fragrance Retention in Two Week Accelerated Test | | | |
|---|---|---|---|---|
| | % RETENTION | | | |
| | "Pet Fresh" | "Country Fresh" | "Fresh Country Breeze" | Avg. All Fragrances |
| EXAMPLE 1 (PVDC/PP/PVDC Laminate) | 88.5 | 81.0 | 83.0 | 84.2 |
| CONTROL B (PET Laminate)) | 85.0 | 82.0 | 86.5 | 84.5 |
| CONTROL G (PVC Overwrap) | 81.5 | 84.5 | 83.0 | 83.0 |

The barrier material of EXAMPLE 1 exhibited about the same fragrance retention as that of CONTROL B and slightly greater fragrance retention than CONTROL G.

Long Term Container Stability Testing

The fragrance retention characteristics of containers incorporating the barrier layers or overwrap of EXAMPLE 1 and CONTROLS B and G were determined by the panel test evaluation protocol described with reference to EXAMPLE 1 above. The fragrance retention of the respective samples, calculated as percentages of the refrigerated control, are set forth in TABLE 8 below:

TABLE 8

| BARRIER | Panel Results Re Fragrance Retention After Long Term Stability Test | | | | | | | | | | | |
|---|---|---|---|---|---|---|---|---|---|---|---|---|
| | "Pet Fresh" | | | "Country Fresh" | | | "Fresh Country Breeze" | | | Average All Fragrances | | |
| | 1 mo. | 2 Mos. | 3 Mos. | 1 Mo. | 2 Mos. | 3 Mos. | 1 Mo. | 2 Mos. | 3 Mos. | 1 Mo. | 2 Mos. | 3 Mos. |
| EXAMPLE 1 (PVDC/PP/PVDC Laminate) | 83 | 87 | 77 | 83 | 83 | 76 | 94 | 90 | 83 | 87 | 87 | 79 |
| CONTROL B (PET Laminate) | 74 | 70 | 70 | 87 | 79 | 83 | 91 | 84 | 80 | 84 | 78 | 78 |
| CONTROL G (PVC Overwrap) | 71 | 82 | 80 | 81 | 74 | 75 | 89 | 82 | 78 | 80 | 79 | 78 |

The % fragrance retention by the containers of EXAMPLE 1 and CONTROLS B and G was also determined by chemical analysis. The analyses were performed by extraction of the fragrance from each carpet deodorizer composition with ethanol. The ethanol was then filtered and the ultraviolet absorbance of the resulting solution measured at a specific wavelength. By comparing the UV-absorbance of the sample with that of a previously prepared standard the amount of fragrance present in the sample was calculated. By comparing the amount of fragrance in a refrigerated sample with that in the respective container-stored samples, percentage values were derived representing the fragrance retention of the respective test containers.

The analytical values are set forth in TABLE 9 below:

TABLE 9

Analytical Fragrance Retention After Long Term Stability Test

| | FRAGRANCE | | | | | | | | | | | |
|---|---|---|---|---|---|---|---|---|---|---|---|---|
| | "Pet Fresh" | | | "Country Fresh" | | | "Fresh Country Breeze" | | | Average All Fragrances | | |
| Barrier | 1 Mo. | 2 Mos. | 3 Mos. | 1 Mo. | 2 Mos. | 3 Mos. | 1 Mo. | 2 Mos. | 3 Mos. | 1 Mo. | 2 Mos. | 3 Mos. |
| EXAMPLE 1 (PVDC/PP/PVDC Laminate) | 83 | 77 | 73 | 76 | 75 | 64 | 92 | 88 | 87 | 84 | 80 | 75 |
| CONTROL B (PET Laminate) | 85 | 80 | 73 | 78 | 73 | 60 | 90 | 85 | 85 | 84 | 79 | 73 |
| CONTROL G (PVC Overwrap) | 78 | 75 | 73 | 67 | 64 | 49 | 72 | 68 | 68 | 72 | 69 | 63 |

Finally, the character of fragrance retention, i.e., the similarity of the residual fragrance of the test samples to the original (refrigerator-stored) fragrance sample was determined by panel evaluation, using a protocol similar to that described initially in connection with EXAMPLE 1. The character of the fragrance of a positive control (a refrigerated sample) was evaluated and assigned a "0" value. The similarity of the character of the further test samples was then rated on a 0 to 10 scale, and the results averaged. The following results were obtained:

TABLE 10

Panel Results Re Fragrance Character Retention After Long Term Stability Test

| | FRAGRANCE | | | | | | | | | | | |
|---|---|---|---|---|---|---|---|---|---|---|---|---|
| | "Pet Fresh" | | | "Country Fresh" | | | "Fresh Country Breeze" | | | Average All Fragrances | | |
| Barrier | 1 Mo. | 2 Mos. | 3 Mos. | 1 Mo. | 2 Mos. | 3 Mos. | 1 Mo. | 2 Mos. | 3 Mos. | 1 Mo. | 2 Mos. | 3 Mos. |
| EXAMPLE 1 (PVDC/PP/PVDC Laminate | 2.3 | 0.8 | 2.2 | 0.9 | 2.1 | 2.5 | 1.0 | 1.2 | 1.4 | 1.4 | 1.4 | 2.0 |
| CONTROL B (PET Laminate) | 0.5 | 1.7 | 2.1 | 1.1 | 0.7 | 2.4 | 0.7 | 0.1 | 1.6 | 0.8 | 0.8 | 2.0 |
| CONTROL G (PVC Overwrap) | 2.4 | 3.2 | 4.3 | 0.6 | 0.3 | 2.3 | 0.7 | 1.6 | 3.7 | 1.2 | 1.7 | 3.4 |

It may be seen from TABLES 8–10 that the PVDC/PP/PVDC Laminate barrier (EXAMPLE 1) outperformed the PVC Overwrap barrier (CONTROL G) and was equivalent to the PET Laminate barrier (CONTROL B) in both fragrance retention and character, over the extended test periods.

It should be understood that various changes may be made in the specific embodiments described hereinabove without departing from the scope of the invention as defined in the following claims.

What is claimed is:

1. A three dimensional resealable fiber board container for solid, pulverized materials incorporating fragrance-producing ingredients, said container comprising:

(a) a bottom portion;

(b) four side portions;

(c) a top portion defined by a top hinged flap extending from each side portion, the top hinged flaps comprising (i) an inner-most flap extending over only a part of the top portion, the flap having a plurality of parallel glue-assist perforations extending lengthwise over substantially the entire flap and extending partially into the depth of the flap;

(ii) a second inner-most flap partially overlapping the inner-most flap to form a common overlapping region, the second inner-most flap having a plurality of parallel glue-assist perforations adjacent the abutting side portion and extending lengthwise over substantially the entire second inner-most flap and extending partially into the depth of the second inner-most flap, the second inner-most flap being provided with dispensing openings therein through which said materials may be dispensed;

(iii) a second outer-most flap being provided with a displaceable die-cut piece aligned with the dispensing openings in the second inner-most flap, the second outer-most flap having (1) a first set of parallel glue-assist perforations adjacent the abutting the side portion, extending lengthwise over substantially the entire second outer-most flap and extending partially into the depth of the second outer-most flap, aligned with the glue-assist perforations of the second inner-most flap; and (2) a second set of parallel glue-assist perforations remote from the abutting side portion and extending lengthwise over substantially the entire second outermost flap and extending partially into the depth of the second outer-most flap, aligned with the glue-assist perforations of the inner-most flap;

(iv) glue joints between the glue-assist perforations of the second outer-most flap and the aligned glue-assist perforations of the inner-most and second inner-most flaps for forming a secure bond between said flaps; and (v) an outer-most flap having a hinged flap portion for opening and closing the container, the hinged flap portion being secured to the die-cut piece of the second outer-most flap to permit dispensing of said materials upon opening the hinged flap portion and re-sealing of the container upon closing the hinged flap portion to prevent loss of said materials and to limit the fragrance-producing ingredients from escaping outwardly therefrom; and (d) a polyvinylidene chloride layer formed on the interior of the bottom portion, the side portions and on the hinged flaps defining the top portion of the container and including each of the flaps (i)–(iv) thereof, the polyvinylidene chloride layer limiting the fragrance-producing ingredients from escaping outwardly from the container during storage or use thereof.

2. The container of claim 1, wherein the polyvinylidene chloride layer is laminated to the interior of the side, bottom and top portions of the container.

3. The container of claim 1, wherein the innermost flap tapers inwardly from the abutting side portion alleviating binding of the flap during assembly of the container.

* * * * *